US009247369B2

(12) United States Patent
Xu et al.

(10) Patent No.: US 9,247,369 B2
(45) Date of Patent: Jan. 26, 2016

(54) METHOD FOR ENLARGING A LOCATION WITH OPTIMAL THREE-DIMENSIONAL AUDIO PERCEPTION

(75) Inventors: Jun Xu, Singapore (SG); Huayun Zhang, Singapore (SG)

(73) Assignee: Creative Technology Ltd, Singapore (SG)

( * ) Notice: Subject to any disclaimer, the term of this patent is extended or adjusted under 35 U.S.C. 154(b) by 348 days.

(21) Appl. No.: 12/698,085

(22) Filed: Feb. 1, 2010

(65) Prior Publication Data

US 2011/0188660 A1 Aug. 4, 2011

(51) Int. Cl.
*H04R 5/00* (2006.01)
*H04S 3/00* (2006.01)

(52) U.S. Cl.
CPC ..... *H04S 3/002* (2013.01)

(58) Field of Classification Search
CPC ..... H04S 3/02; H04S 3/002; H04S 2400/15; H04S 2420/11; H04S 2420/01; H04S 5/00; H04S 7/30; H04S 2400/11; H04S 2420/03; H04S 7/301; H04S 1/00; H04S 1/002; H04S 2400/03; H04S 2400/05; H04S 2400/07; H04R 2227/003; H04R 2205/041; H04R 2217/03; H04R 2225/67; H04R 2499/13; H04R 25/606; H04R 29/00; H04R 29/001; H04R 3/002; H04R 3/12; H04R 5/02; H04R 5/033; H04R 5/04
USPC ..... 381/1, 300, 303, 307, 17–23, 27, 309, 381/310; 369/4, 5, 86, 89, 91, 92
See application file for complete search history.

(56) References Cited

U.S. PATENT DOCUMENTS

| | | | | |
|---|---|---|---|---|
| 5,761,315 | A * | 6/1998 | Iida et al. | 381/18 |
| 6,073,100 | A * | 6/2000 | Goodridge, Jr. | 704/258 |
| 6,111,181 | A * | 8/2000 | Macon et al. | 84/603 |
| 7,006,645 | B2 * | 2/2006 | Fujita et al. | 381/307 |
| 7,167,567 | B1 * | 1/2007 | Sibbald et al. | 381/310 |
| 7,263,193 | B2 * | 8/2007 | Abel | 381/1 |
| 2003/0007648 | A1 * | 1/2003 | Currell | 381/61 |
| 2004/0170281 | A1 * | 9/2004 | Nelson et al. | 381/17 |
| 2004/0196982 | A1 * | 10/2004 | Aylward et al. | 381/17 |
| 2005/0117762 | A1 * | 6/2005 | Sakurai et al. | 381/309 |
| 2005/0271214 | A1 * | 12/2005 | Kim | 381/17 |
| 2005/0281408 | A1 * | 12/2005 | Kim et al. | 381/17 |

(Continued)

FOREIGN PATENT DOCUMENTS

JP 2008-154082 * 7/2008 ..... H04S 5/02

*Primary Examiner* — Lun-See Lao
(74) *Attorney, Agent, or Firm* — Russell Swerdon; Desmund Gean

(57) ABSTRACT

There is provided a method for enlarging a location with optimal three-dimensional audio perception. Optimal three-dimensional audio perception may relate to a fully spatial sound effect. The method includes deriving three-dimensional encoded localization cues from an audio input signal having a first channel signal and a second channel signal; decoding the first channel signal and the second channel signal into a plurality of decoded channel signals, the plurality of decoded channel signals being equal to a number of speaker units; performing crosstalk cancellation on the plurality of decoded channel signals to eliminate crosstalk between the plurality of decoded channel signals; and outputting the plurality of decoded channel signals which have been subjected to crosstalk cancellation to each of the number of speaker units. It is advantageous that the crosstalk cancellation includes further processing to generate a smoothed frequency envelope.

9 Claims, 4 Drawing Sheets

(56) References Cited

U.S. PATENT DOCUMENTS

2006/0210087 A1* 9/2006 Davis et al. ..... 381/17
2007/0154020 A1* 7/2007 Katayama ..... 381/17
2007/0269063 A1* 11/2007 Goodwin et al. ..... 381/310
2008/0031462 A1* 2/2008 Walsh et al. ..... 381/17
2008/0056503 A1* 3/2008 McGrath ..... 381/17
2008/0205676 A1* 8/2008 Merimaa et al. ..... 381/310
2008/0273721 A1* 11/2008 Walsh ..... 381/300
2009/0092259 A1* 4/2009 Jot et al. ..... 381/17

* cited by examiner $c_{ij}$ is frequency response at ear position $E_j$ to real source $s_i$.

$v_{ij}$ is frequency response at ear position $E_j$ to virtual source $s_i$.

METHOD FOR ENLARGING A LOCATION WITH OPTIMAL THREE-DIMENSIONAL AUDIO PERCEPTION

CROSS REFERENCE TO RELATED APPLICATIONS

This application includes references to matter disclosed in U.S. Ser. No. 12/246,491, filed on 6 Oct. 2008.

FIELD OF INVENTION

The present invention relates to audio signal processing processes. Specifically, the present invention relates to a method for processing audio signals.

BACKGROUND

Stereo signals may be decoded into multi-channel audio to provide a user with a sense of immersion and realism when experiencing the multi-channel audio through a plurality of speakers. The decoding of signals into multi-channel audio may be carried out using techniques disclosed in U.S. Ser. No. 12/246,491, which is another patent application filed by Creative Technology Ltd.

It should be noted that a cinema hall typically includes a plurality of speakers distributed in a wide spread loudspeaker layout throughout the cinema hall with the plurality of speakers being directed at cinema goers seated in the cinema hall such that a spatial sound effect is experienced by the cinema goers.

Unfortunately, arranging a plurality of speakers in a wide spread loudspeaker layout in a relatively smaller enclosed area compared to the cinema hall, such as, for example, a room in a home is not convenient due to constraints in the size of the enclosed area and the fact that the presence of the plurality of speakers would appear odd. However, it would be highly desirable if spatial sound effects could be reproduced in the home. Furthermore, given the prevalence of compact speaker-array units being found in homes, it would be desirable if spatial sound effects may be reproduced in homes using compact speaker-array units.

In addition, it would also be desirable if the compact speaker-array units could reproduce spatial sound effects over an enlarged location as it is unlikely that persons in a home remain seated at a single location unlike movie-goers in a cinema hall.

The present invention aims to address the aforementioned situations.

SUMMARY

There is provided a method for enlarging a location with optimal three-dimensional audio perception. Optimal three-dimensional audio perception may relate to a fully spatial sound effect.

The method includes deriving three-dimensional encoded localization cues from an audio input signal having a first channel signal and a second channel signal; decoding the first channel signal and the second channel signal into a plurality of decoded channel signals, the plurality of decoded channel signals being equal to a number of speaker units; performing crosstalk cancellation on the plurality of decoded channel signals to eliminate crosstalk between the plurality of decoded channel signals; and outputting the plurality of decoded channel signals which have been subjected to crosstalk cancellation to each of the number of speaker units.

It is advantageous that the crosstalk cancellation includes further processing to generate a smoothed frequency envelope.

The smoothed frequency envelope may be reconstructed from truncated cepstrals derived from converting each of the plurality of decoded channel signals into the cepstrum spectrum. The smoothed frequency envelope also minimizes timbre artifacts, the timbre artifacts being high peaks and low valleys in the cepstrum spectrum of each of the plurality of decoded channel signals.

The localization cues may include at least for example, an up-down dimension, a left-right dimension, a front-back dimension, an azimuth angle, an elevation angle and so forth. The derivation of the three-dimensional encoded localization cues may be based on providing a listener with a fully spatial sound effect.

The enlarged location with optimal three-dimensional audio perception advantageously allows a listener to move about as the enlarged location relates to a boundary which encompasses a plurality of positions with optimal three-dimensional audio perception.

The method may preferably further include summing the plurality of decoded channel signals which have been subjected to crosstalk cancellation before output to each of the number of speaker units. Each speaker unit may include at least one speaker driver. Preferably, the crosstalk cancellation may be performed to cause a listener to perceive audio to be emanated from virtual speakers.

DESCRIPTION OF DRAWINGS

In order that the present invention may be fully understood and readily put into practical effect, there shall now be described by way of non-limitative example only preferred embodiments of the present invention, the description being with reference to the accompanying illustrative drawings.

DESCRIPTION OF PREFERRED EMBODIMENTS

Figure 1:
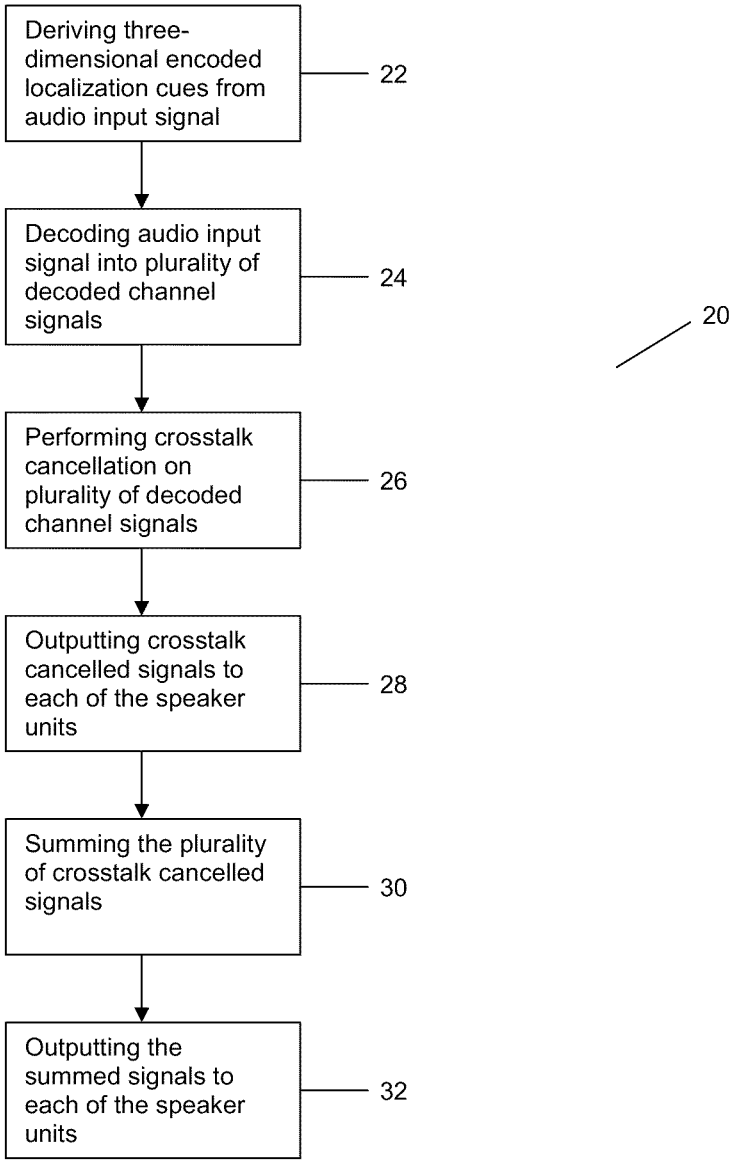
FIG. 1 shows a process flow for a method of the present invention.
Figure 2:
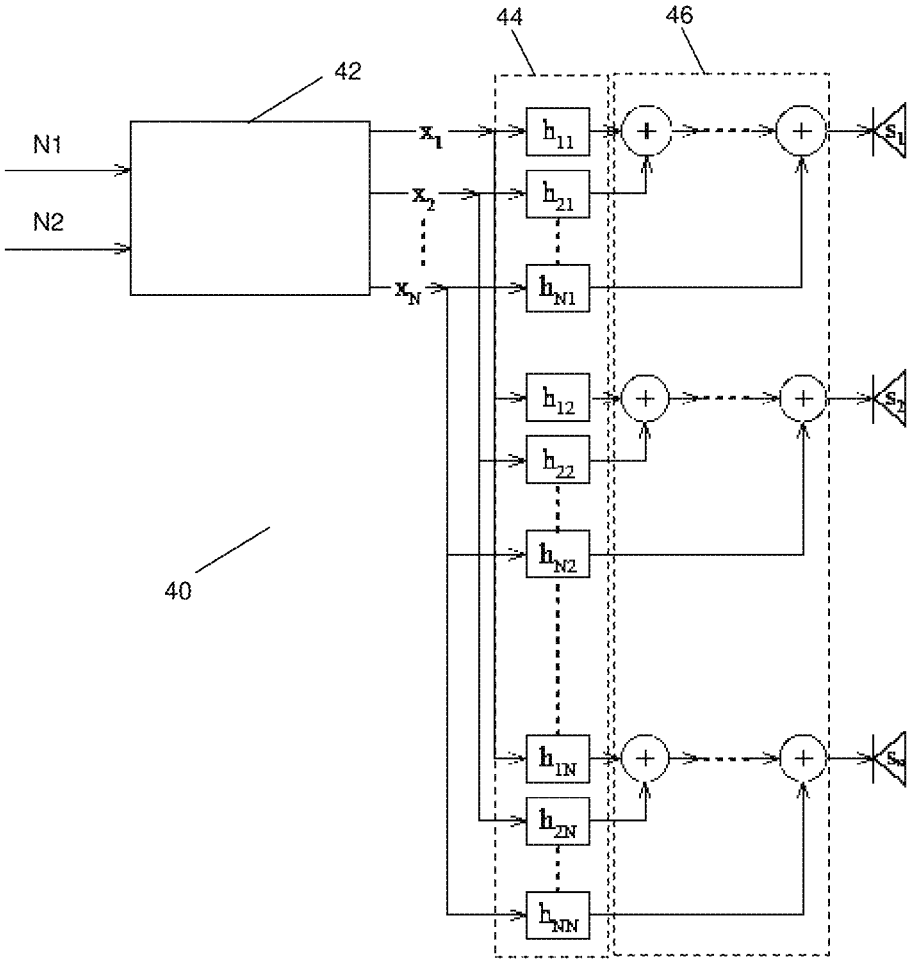
FIG. 2 shows a schematic view of a system used for carrying out the method of FIG. 1.

Referring to FIGS. 1 and 2, there is provided a process flow for a method 20 for enlarging a location with optimal three-dimensional audio perception (also known by the theoretical concept of "audio sweet spot"), and a schematic view of an apparatus 40 used for carrying out the method 20 respectively. FIGS. 1 and 2 will be referred to in subsequent paragraphs when describing the method 20 and apparatus 40 respectively. It should be appreciated that the method 20 and the apparatus 40 are described herein for illustrative purposes and should not be construed to be limiting in any manner. Optimal three-dimensional audio perception relates to a fully spatial sound effect. It should also be appreciated that the enlarged location with optimal three-dimensional audio perception allows a listener to move about as the enlarged location relates to a boundary which encompasses a plurality of positions with optimal three-dimensional audio perception.

The method 20 for enlarging a location with optimal three-dimensional audio perception includes deriving three-dimensional encoded localization cues from an audio input signal having a first channel signal and a second channel signal (22). The audio input signal with the first channel signal and the second channel signal may be known as a stereo signal. The techniques for deriving the three-dimensional encoded localization cues may relate to audio signal processing techniques described in U.S. Ser. No. 12/246,491 or any other known audio signal processing technique. The derivation of the three-dimensional encoded localization cues is an essential step to reproduce a fully spatial sound effect. The localization cues includes, for example, an up-down dimension, a left-right dimension, a front-back dimension, an azimuth angle, an elevation angle and so forth.

Figure 4:
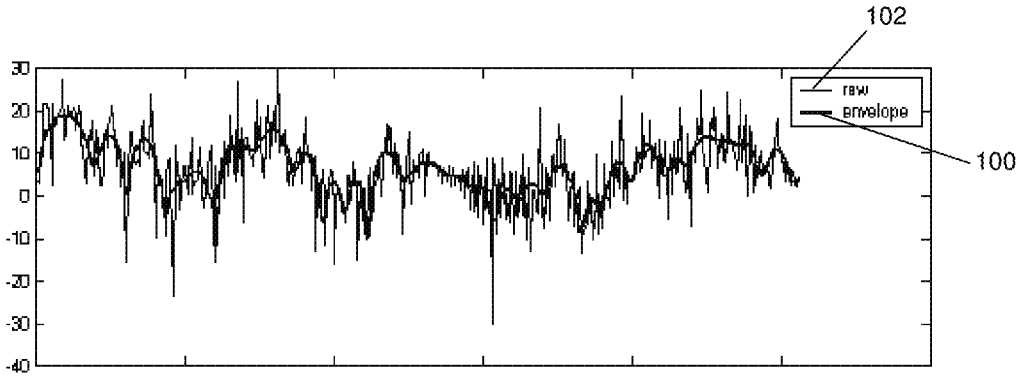
FIG. 4 shows an illustration of a smoothed frequency envelope in a cepstrum spectrum.

The method 20 also includes decoding the first channel signal and the second channel signal into a plurality of decoded channel signals (24), the plurality of decoded channel signals being equal to a number of speaker units. Each speaker unit may include at least one speaker driver. Subsequently, crosstalk cancellation may be performed on the plurality of decoded channel signals (26) to eliminate crosstalk between the plurality of decoded channel signals. Crosstalk cancellation is performed to cause the listener to perceive audio to be emanated from virtual speakers. Crosstalk cancellation eliminates the crosstalk between channels. Crosstalk cancellation also includes further processing to generate a smoothed frequency envelope 100 as shown in FIG. 4. The smoothed frequency envelope 100 is reconstructed from truncated cepstrals derived from converting each of the plurality of decoded channel signals into the cepstrum spectrum (labeled as "raw" 102). The smoothed frequency envelope 100 minimizes timbre artifacts, the timbre artifacts being high peaks and low valleys in the "raw" 102 graph in the cepstrum spectrum of each of the plurality of decoded channel signals.

Consequently, the method 20 further includes summing the plurality of decoded channel signals (30) which have been subjected to crosstalk cancellation before output to each of the number of speaker units. Finally, the method 20 includes outputting each of the summed decoded channel signals (32) which have been subjected to crosstalk cancellation to each of the number of speaker units such that the listener is able to enjoy the fully spatial sound effect with an enlarged location with optimal three-dimensional audio perception. The concept of the enlarged location will be described in further detail in the subsequent paragraphs.

Figure 5:
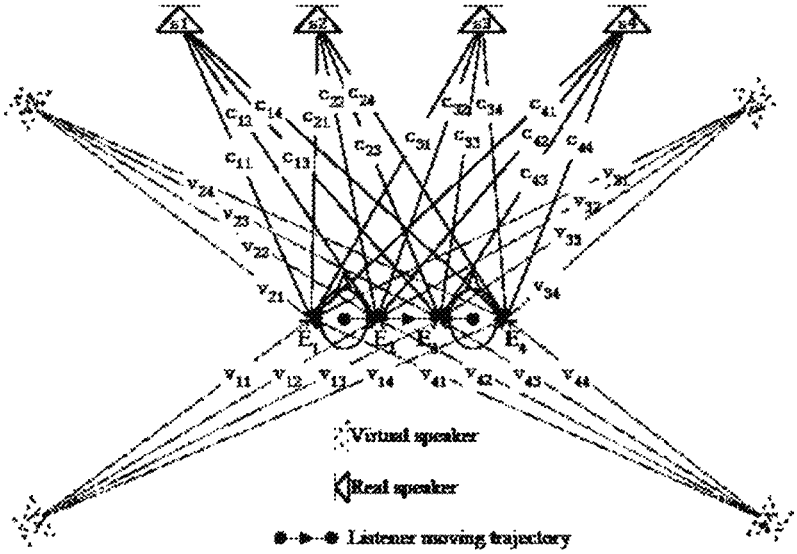
FIG. 5 shows a visual representation of 3D audio reproduction using one loudspeaker array.

Referring to FIG. 5, there is shown a visual representation of 3D audio reproduction using one loudspeaker array with four speakers. It should be noted that the region between $E_1$ and $E_4$ represents the enlarged location (area where lines from the virtual speakers v1, v2, v3, v4 intersect) with optimal three-dimensional audio perception. Head related transfer functions (HRTFs) describe time and amplitude differences that are imposed on a listener's binaural responses to any sound event. These differences are attributed to the listener's head and pinnae structure and are used by ears to detect where sound emanates from. Loudspeaker/headphone virtualization is designed using HRTFs to provide the listener with the perception of sound emanating from virtual rather than actual speakers.

Mathematical representations will now be provided to illustrate the concept of the enlarged location with optimal three-dimensional audio perception:

X is the multichannel audio produced by deriving three-dimensional encoded localization cues from an audio input signal (22 in method 20).

Y is the transaural audio perceived by the listener.

$H_c$ is a HRTF matrix from the real audio sources to the listener.

$H_v$ is a HRTF matrix from the virtual audio sources to the listener.

$\hat{X}$ is the virtualization output sent to the real audio sources.

ifft relates to "inverse discrete fourier transform".

fft relates to "fast fourier transform".

$$Y = H_c X$$

$$\begin{bmatrix} y_1 \\ y_2 \\ \vdots \\ y_N \end{bmatrix} = \begin{bmatrix} c_{11} & c_{21} & \cdots & c_{N1} \\ c_{12} & c_{22} & \cdots & c_{N2} \\ \vdots & \vdots & \ddots & \vdots \\ c_{1N} & c_{2N} & \cdots & c_{NN} \end{bmatrix} \begin{bmatrix} x_1 \\ x_2 \\ \vdots \\ x_N \end{bmatrix}$$

$$\begin{aligned} \hat{X} &= H_c^{-1} H_v X \\ &= HX \\ &= \begin{bmatrix} h_{11} & h_{21} & \cdots & h_{N1} \\ h_{12} & h_{22} & \cdots & h_{N2} \\ \vdots & \vdots & \ddots & \vdots \\ h_{1N} & h_{2N} & \cdots & h_{NN} \end{bmatrix} \begin{bmatrix} x_1 \\ x_2 \\ \vdots \\ x_N \end{bmatrix} \end{aligned}$$

H is converted into cepstrum spectrum, $$\text{ceps}=\text{ifft}(\log(\text{abs}(H)))$$

Subsequently, smoothed spectral envelopes are reconstructed from truncated cepstrals, $$H_{smooth}=\exp(\text{fft}(\text{window}(\text{ceps})))$$

The smoothed spectral envelopes 100 may be seen in FIG. 4.

Figure 3:
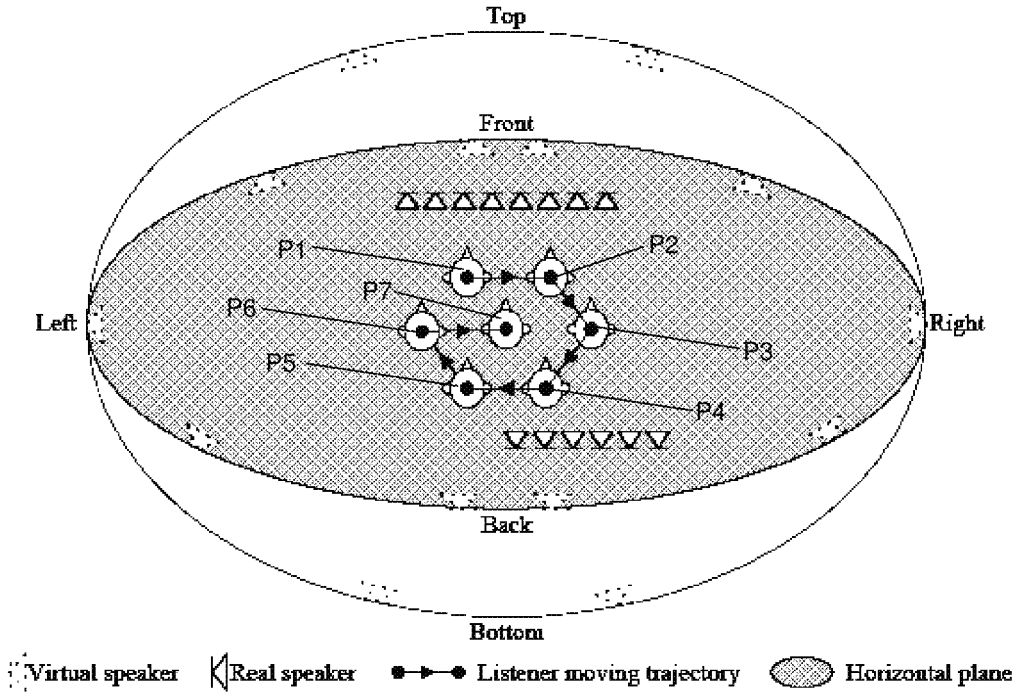
FIG. 3 shows a visual representation of 3D audio reproduction using two loudspeaker arrays.

Referring to FIG. 3, there is shown a visual representation of 3D audio reproduction using two loudspeaker arrays. Seven positions of the listener, P1, P2, P3, P4, P5, P6, P7 represent positions where the listener is able to perceive optimal three-dimensional audio perception, where the positions are obtainable from the mathematical processes as detailed in the preceding paragraphs. The seven positions may be deemed to denote a boundary of an area where the listener experiences optimal three-dimensional audio perception.

Referring to FIG. 2, there is shown a schematic view of a system 40 used for carrying out the method 20. The system 40 allows input of audio input signals in the form of stereo signals (N1 and N2) into a decoder 42 of the system 40. The decoder 42 may process N1 and N2 to derive three dimensional encoded localization cues and decode N1 and N2 into a plurality of decoded channel signals ($x_1, x_2, \ldots, x_N$).

The system 40 includes a plurality of audio filters 44 for performing crosstalk cancellation on the plurality of decoded channel signals ($x_1, x_2, \ldots, x_N$).

Crosstalk cancellation is performed to cause the listener to perceive audio to be emanated from virtual speakers. Crosstalk cancellation eliminates the crosstalk between channels. Crosstalk cancellation also includes further processing to generate a smoothed frequency envelope 100 as shown in FIG. 4.

The system 40 includes a plurality of signal summing circuits 46 for summing the plurality of crosstalk cancelled signals. Finally, the plurality of crosstalk cancelled signals which have been summed are output to a plurality of speaker units ($S_1, S_2, \ldots, S_N$) such that the listener is able to enjoy the fully spatial sound effect with an enlarged location with optimal three-dimensional audio perception.

Whilst there has been described in the foregoing description preferred embodiments of the present invention, it will be understood by those skilled in the technology concerned that many variations or modifications in details of design or construction may be made without departing from the present invention.

The invention claimed is:

1. A method for enlarging a location with optimal three-dimensional audio perception, the method including:

deriving three-dimensional encoded localization cues from an audio input signal having a first channel signal and a second channel signal;

decoding the first channel signal and the second channel signal into a plurality of decoded channel signals;

performing crosstalk cancellation on the plurality of decoded channel signals to eliminate crosstalk between the plurality of decoded channel signals;

summing the plurality of decoded channel signals which have been subjected to crosstalk cancellation; and outputting the summed decoded channel signals which have been subjected to crosstalk cancellation, wherein the plurality of decoded channel signals subjected to crosstalk cancellation are summed.

2. The method of claim 1, wherein the localization cues include at least one selected from a group consisting of: an up-down dimension, a left-right dimension, a front-back dimension, an azimuth angle, and an elevation angle.

3. The method of claim 1, wherein the enlarged location with optimal three-dimensional audio perception allows a listener to move about as the enlarged location relates to a boundary which encompasses a plurality of positions with optimal three-dimensional audio perception.

4. The method of claim 1, wherein each speaker unit includes at least one speaker driver.

5. The method of claim 1, wherein the crosstalk cancellation is performed to cause a listener to perceive audio to be emanated from virtual speakers.

6. The method of claim 1, wherein derivation of the three-dimensional encoded localization cues is based on providing a listener with a fully spatial sound effect.

7. The method of claim 1, wherein the smoothed frequency envelope is reconstructed from truncated cepstrals derived from converting each of the plurality of decoded channel signals into the cepstrum spectrum.

8. The method of claim 7, wherein the smoothed frequency envelope minimizes timbre artifacts, the timbre artifacts being high peaks and low valleys in the cepstrum spectrum of each of the plurality of decoded channel signals.

9. The method of claim 1, wherein optimal three-dimensional audio perception relates to a fully spatial sound effect.

* * * * *